US008727296B1

(12) United States Patent
Dyer

(10) Patent No.: US 8,727,296 B1
(45) Date of Patent: May 20, 2014

(54) COMBINATION FLEXIBLE TRIVET AND COASTER

(76) Inventor: Kelly Dyer, Anchorage, AK (US)

( * ) Notice: Subject to any disclaimer, the term of this patent is extended or adjusted under 35 U.S.C. 154(b) by 195 days.

(21) Appl. No.: 13/348,876

(22) Filed: Jan. 12, 2012

(51) Int. Cl.
*A47B 91/00* (2006.01)

(52) U.S. Cl.
USPC ..... 248/346.11; 220/739

(58) Field of Classification Search
USPC ..... 248/346.11, 346.3, 346.01, 346.4; 220/628, 629, 630, 510, 739, 738, 737, 220/62.21, 62.22, 62.12, 592.24, 592.26
See application file for complete search history.

(56) References Cited

U.S. PATENT DOCUMENTS 4,725,028 A * 2/1988 Conradt ..... 248/150
5,226,585 A * 7/1993 Varano ..... 229/400
5,667,135 A * 9/1997 Schaefer ..... 229/403
7,264,134 B2 * 9/2007 Tulp ..... 220/739
8,286,824 B2 * 10/2012 Ikeda et al. ..... 220/739
2009/0020676 A1 * 1/2009 Curry ..... 248/346.11
2010/0224637 A1 * 9/2010 Ikeda et al. ..... 220/592.2
2010/0276480 A1 * 11/2010 Robertson ..... 229/403
2010/0282922 A1 * 11/2010 McConnell ..... 248/145.6

* cited by examiner

*Primary Examiner* — Alfred J Wujciak
(74) *Attorney, Agent, or Firm* — Michael J. Tavella

(57) ABSTRACT

A combination coaster and trivet that is made of a flexible silicon material. It is molded into a generally square form that have several slits formed in it. These slits allow the form to be folded generally square for use as a coaster, or expanded to form a larger apparatus suitable for use as a trivet. The form has a button formed on one end and a corresponding slot on the other end that allows the user to lock the ends together making a flower like form. Moreover because the material is flexible, the form can be used vertically. Locked together, the device can be used as a potholder to lift and carry hot bowls or pots. For example, the device can be wrapped around a bowl and placed in a microwave oven. When the cooking is complete, the user can remove the hot bowl safely by gripping the device.

16 Claims, 7 Drawing Sheets

COMBINATION FLEXIBLE TRIVET AND COASTER

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to trivets and coasters and particularly to flexible trivets and coaster combinations.

2. Description of the Prior Art

Coasters and trivets have been used for a long time to protect furnishings from water and heat. Typically, coasters are small, round or square blocks that are placed under cups and glasses. They are used to keep heat and moisture from reaching furniture surfaces as both heat and moisture can mar finishes. Like coasters, trivets are used to hold hot plates, pots and serving dishes. Trivets are larger than coasters and come in a variety of styles, although they tend to have two basic shapes-round or square. Some trivets come with cast iron frames with handles. Others are made of soft mats. For the most part, however, coasters and trivets are not interchangeable. Coasters are too small to hold serving dishes and trivets are too large to conveniently hold drinks on a small table. Thus, people have sets of coasters and trivets that they use separately as there is no functional overlap of these items.

BRIEF DESCRIPTION OF THE INVENTION

The instant invention overcomes this problem. It is a combination coaster and flexible trivet that is made of a flexible silicon material. It is molded into a generally square form that have several slits formed in it. These slits allow the form to be folded generally square for use as a coaster, or expanded to form a larger apparatus suitable for use as a trivet. Note that the term "trivet" as used herein means a flexible device that can be used flat but also has vertical configuration capabilities. The form has a button formed on one end and a corresponding slot on the other end that allows the user to lock the ends together making a flower like form. Moreover because the material is flexible, the form can be used vertically, thus making it a flexible trivet and coaster with vertical configuration capabilities. Locked together, the device can be used as a potholder to lift and carry hot bowls or pots. For example, the device can be wrapped around a bowl and placed in a microwave oven. When the cooking is complete, the user can remove the hot bowl safely by gripping the device—thus eliminating the need to separate potholders that can be awkward to use.

DETAILED DESCRIPTION OF THE INVENTION

Figure 1:
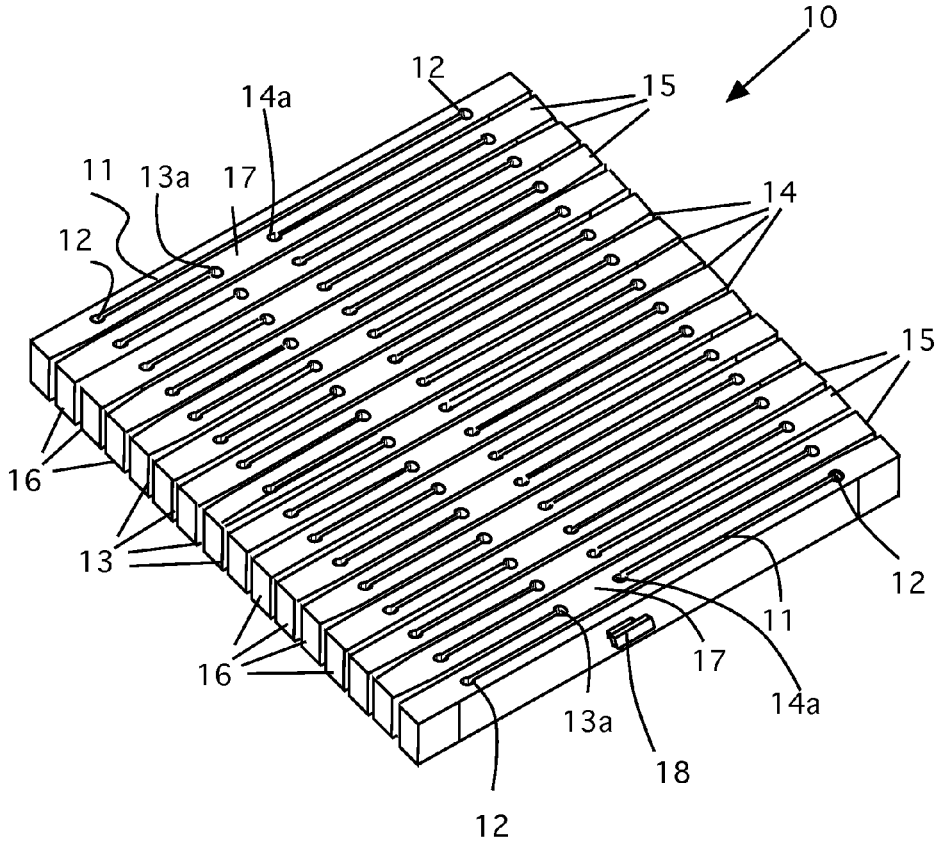
FIG. 1 is a perspective view of the invention in the collapsed configuration.

Referring now to FIG. 1, a perspective view of the invention 10 in the collapsed configuration is shown. The device is made of temperature resistant silicone. This material is rated to hold a hot surface of at least 300° C. (572° F.) for at least 3 minutes without any effect. The material is injection molded to produce the flat, square trivet or coaster.

The square form is actually a molded body having a generally rectangular shape with a left end, a right end, a top end, and a bottom end. The molded body 10 is made up of a number of connected segments that are formed during the molding process. As shown in this figure, there are two different types of slits that formed in the material. First, are a series of long slits 11 that are formed along the longitudinal length of the square. The slits 11 run almost the entire length of the square and they leave two formed ends, as described below. At the ends of the slits 11 are circular openings 12. The circular openings 12 are important because they relieve the material when it is stretched (see FIG. 2.). The long slits 11 are used to make the large openings 11*a* (see also FIG. 2) when the device is pulled open.

Figure 2:
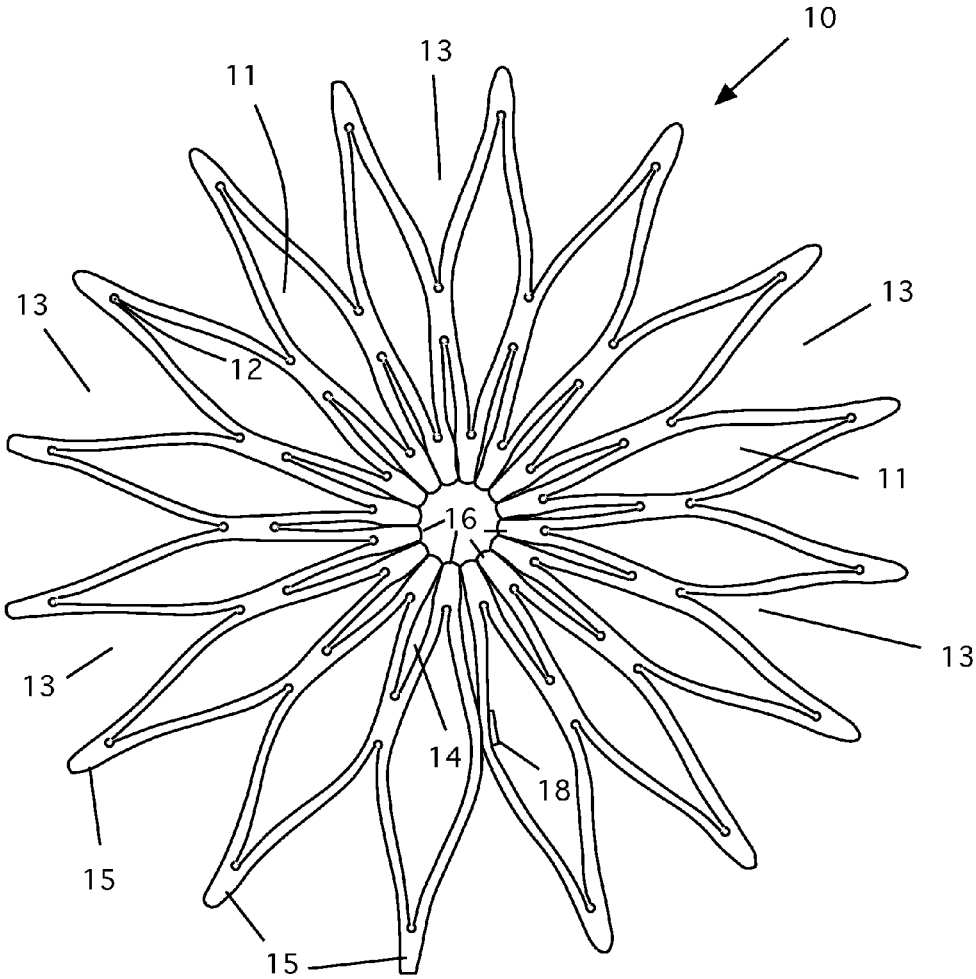
FIG. 2 is a top plan view of the invention in its fully open and connected configuration.
Figure 5:
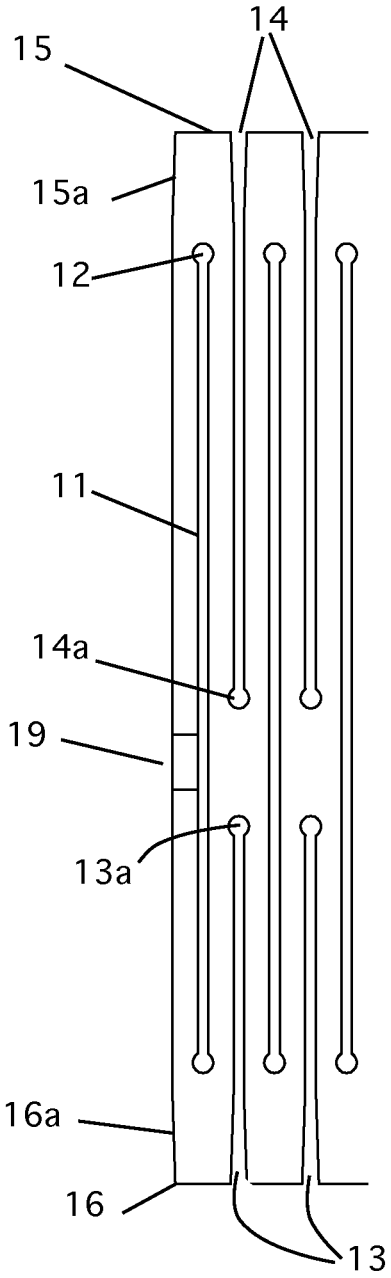
FIG. 5 is an enlarged detail view of the receiver end of the invention.
Figure 6:
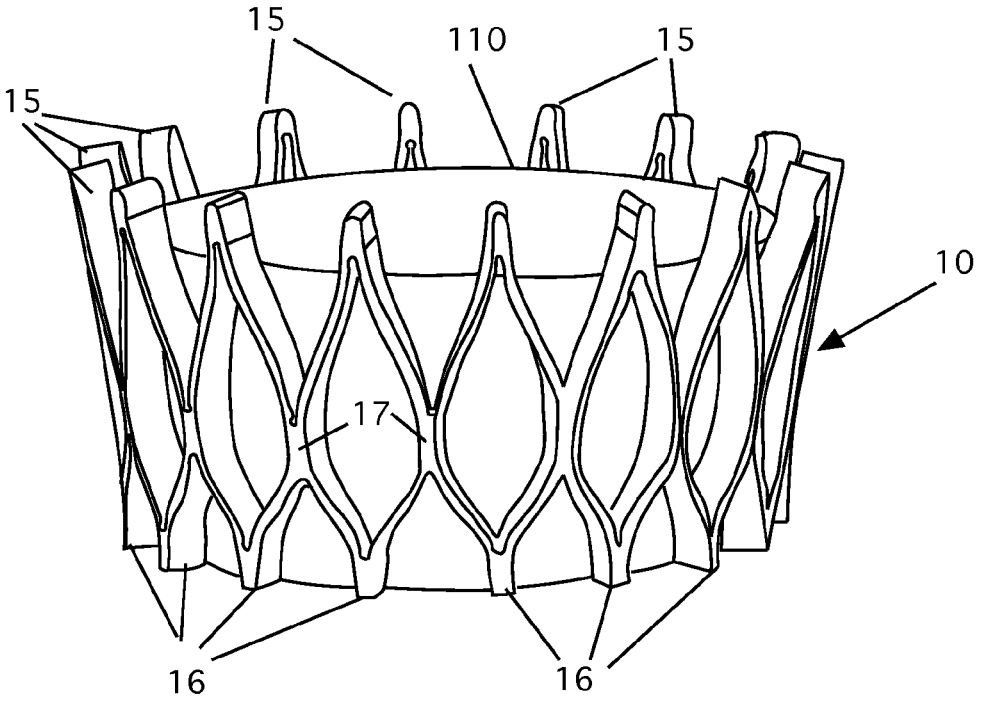
FIG. 6 is a detail view of the invention used in a vertical configuration and surrounding a serving bowl.

The segments are further divided by intermediate slots 13 and 14 (see FIG. 5). Each segment has a distal end 15 and a proximate end 16. The segments are divided by the slits 13 and 14 as shown. Note that these slits also have curved ends 13*a* and 13*b* as shown. Note that unlike slits 11, these slits extend all the way to the edges. In this way, the ends of the segments are separated out. This allows the segments to be opened as shown in FIGS. 2 and 6. The segments are connected together along their length by bridge pieces 17 that are formed as part of the molding process. The bridges pieces are actual places in the mold that are in between the long slits 11 and are the termination points for the slits 13 and 14. The bridges 17 are located not in the center of the segments but at a point about ⅓ of the length (See FIG. 3). The position of these bridges is important because the placement sets the opening angle and widths. Thus, this spacing shown is the preferred embodiment.

Figure 3:
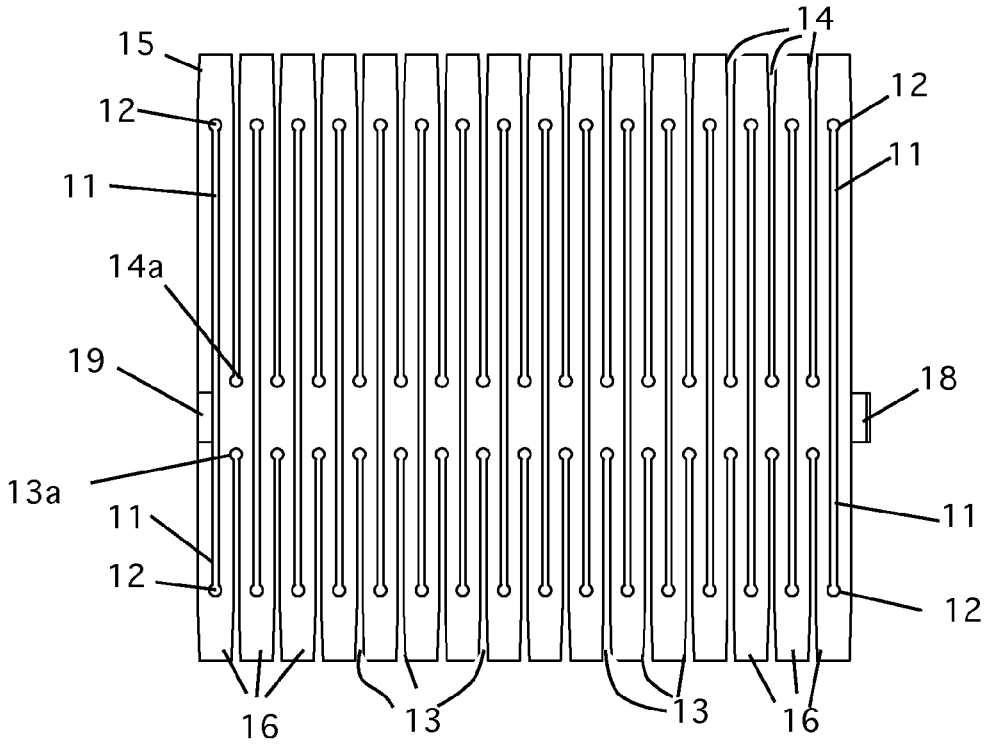
FIG. 3 is a top plan view of the invention in the collapsed configuration.

The device also has a locking tab 18 and a corresponding slot 19 on the other side (see, FIGS. 3 and 5). The locking tab can be used to hold the open the device in an open flat configuration (see FIG. 2) or a vertical configuration (FIG. 6). The locking tab can also be used to connect two or more units together to form a larger trivet in a variety of ways. For example two can be connected and opened to form a large circle and a third connected unit, perhaps of a different color, can be inserted into the opening. As just noted, the units can be made of any desired color.

FIG. 2 is a top plan view of the invention in its fully open and connected configuration. In this figure, the unit is opened and connected. When opened, the segments open as shown. When opened, the segments open and move apart. When the open ends of the device are brought around and locked with tab 18, the device can be laid flat as shown. Note here, how the long slits 11 allow the segments to open into curved ovular shapes. Note too how the slits 13 divide the distal ends 15 of the device into individual segments. Note to how the proximate ends 16 are brought together in the center.

Because the device is made of molded silicone, it is completely flexible and can be shaped in a variety of ways. This ability comes from the way it is formed. FIG. 3 is a top plan view of the invention in the collapsed configuration. Here, the device is shown flat. Note the tab 18 and slot 19 are shown aligned with the bridges 17. Note that For example, if the overall height of the device α is 84 mm, the preferred position of the bridges 17 are not formed in the center of the height of the molded body. Rather, they are positioned closer to the proximate end 14 of the device. Note that the position of the tab 18 in the preferred embodiment is shown by the reference β, which, as measured from the bottom of the device to the center of the bridges, is 32.1 mm.

Figure 4:
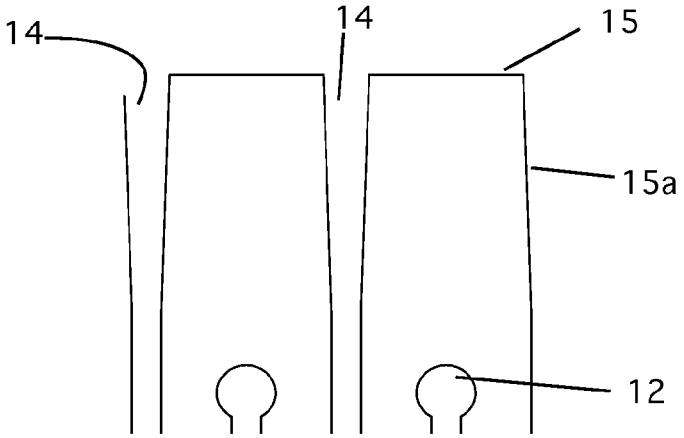
FIG. 4 is an enlarged detail of a portion of FIG. 3, labeled as "4".

FIG. 4 is an enlarged detail of a portion of FIG. 3, labeled as "4". This figure shows the slightly angled tops 15 of each of the distal end segments. Note that both the distal end and proximate ends have angled tops 15*a* for the distal ends and 16*a* for the proximate ends (see, FIG. 5). FIG. 4 also shows an enlargement of the circular openings 12 that are formed at the ends of all of the long slits. Again, these elements are automatically formed as part of the molding process.

FIG. 5 is an enlarged detail view of the receiver end of the invention. Here, a few of the slits 14 are shown, as well as the slits 11, circular openings 12, 13*a* and 14*a*, and the tapered ends 15*a* and 16*a*.

FIG. 6 is a detail view of the invention used in a vertical configuration and surrounding a serving bowl. One of the unique features of this design is the ability of the device to be used in a vertical as well as horizontal form. One form of this is shown in FIG. 6. Here, the device 10 is placed around a bowl 110. This can be done by simply wrapping the device around the bowl and then locking it together with the locking tab 13, as discussed above. Note how the proximate ends 16 spread with the slits 13 Note too how the distal ends spread with the slits 11 and the slits 14. Finally, note how the bridges 17 hold the device together.

Once in place, the device and the bowl can be placed in a microwave oven, for example. When food in the bowl is cooked, the bowl can be safely removed from the microwave by simply holding the device. No additional potholders are needed. Note that the device can be brought directly to a table for serving, leaving it wrapped around the bowl for display, if desired.

The device can be stored vertically also by lifting a locked and opened unit, such as that shown in FIG. 2. When the unit is flat, the user grasps the center formed by the proximate ends 16, and lifts. The device automatically contracts into a cylinder that can be stood on the distal ends of the device. In this way, several units can be compactly stored by stacking them flat together and pulling up on one of the outer ends to flip them into a collective cylinder.

Figure 7:
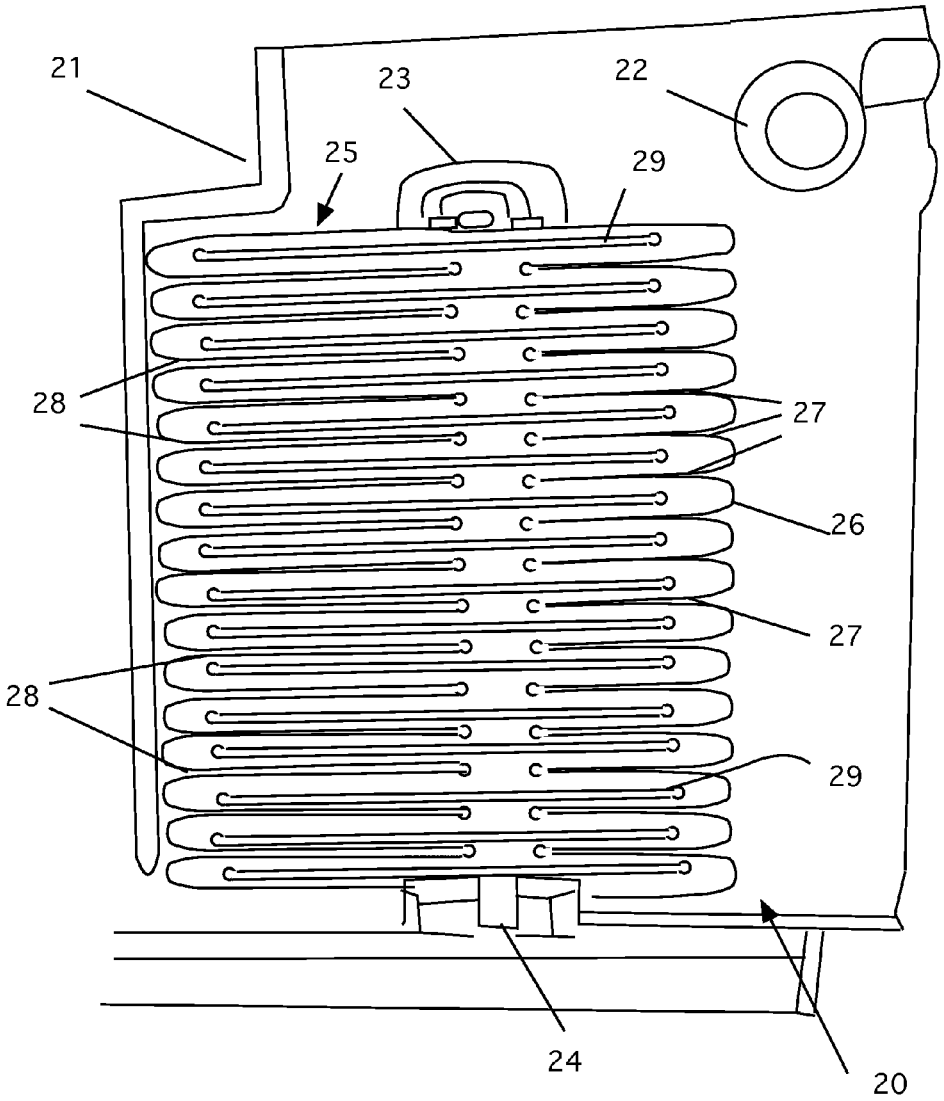
FIG. 7 is a detail of the top of one mold.

As noted above, the key to this device is the molds. FIG. 7 is a detail of the top of one mold 20. This is a mold that has channels 21 for filling with the liquid silicone and connection ports 22 for aligning the top and bottom portions of the mold. In the center of the figure is the portion for making the molded body. At the top is a section 23 for making ½ of the tab 18. At the bottom is a block 24 for forming the open slot 19. Between these points is the main form 25. In this part of the mold, small grooves 26, 27 and 28 are used to frame the shape of the top segments and the slits 13 and 14. The long slits 11 and curved portions 12 are formed be a series of ridges 29 that extend up from the body of the mold. These ridges 29 have the straight portion of the slits and the curved edges. When the silicon is injected, the ridges automatically create the long slits in the molded body.

Figure 8:
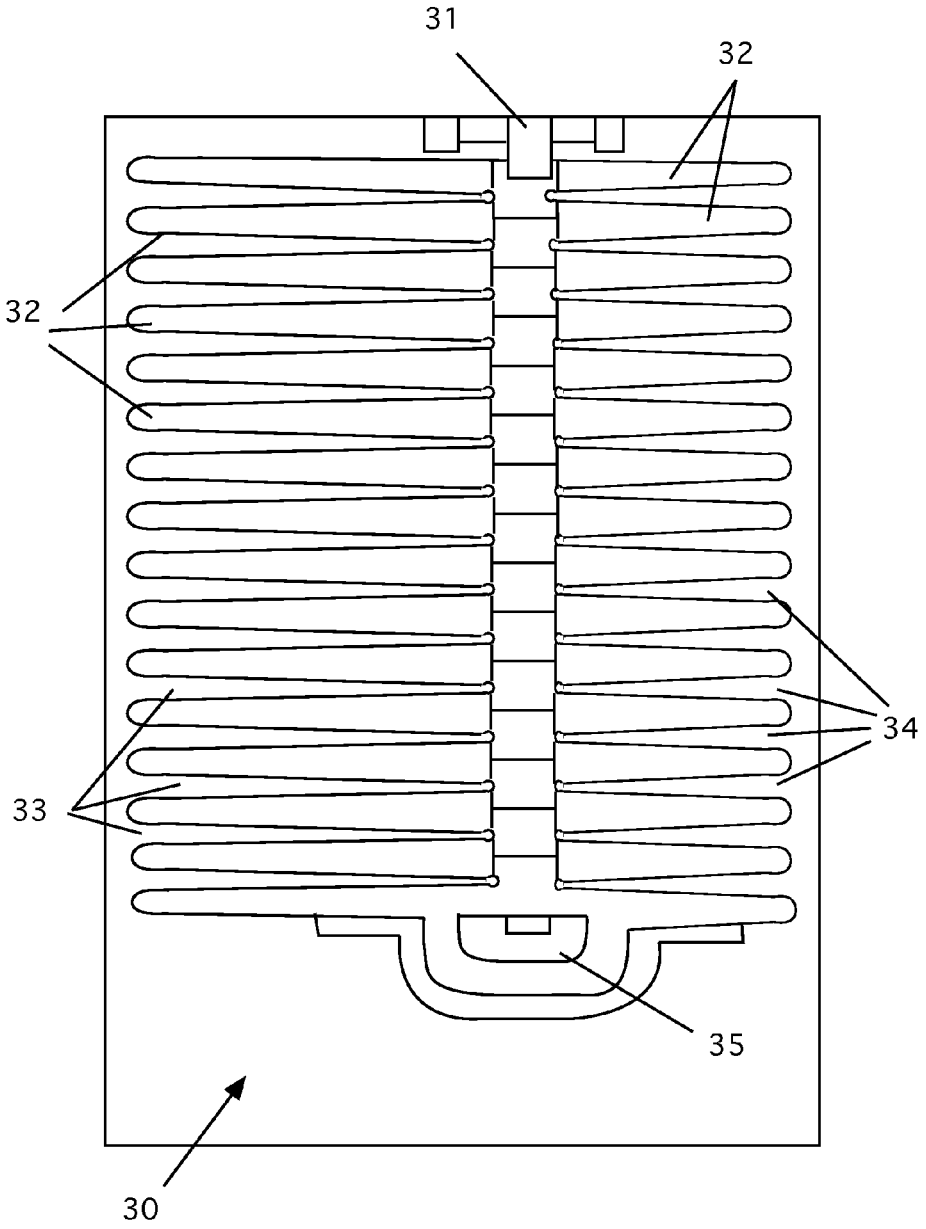
FIG. 8 is a detail of the bottom of one mold.

FIG. 8 is a detail of the bottom of one mold. Note that the drawing for this part of the mold shows the mold body without the exterior features such as alignment keys, etc. Those features are common to any mold and are well known elements of molding. As shown, the lower mold 30 has a form 31 to create the opening 19. Below that, there are several channels 32 that are used to form the body of the device. It is into these open channels that the long slot ridges are placed when the mold is closed. The slots 13 and 14 are automatically formed by the ridges 33 and 34 that are formed between the channels 33. At the bottom of the mold is a form 35 for creating the tab 18.

Once the silicone is injected into the mold, the device is fully formed and ready to use when extracted from the mold.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A combination flexible trivet and coaster comprising:

a) a molded body having a generally rectangular shape having a left end, a right end, a top end, a bottom end and a height extending from the top end to the bottom end, said molded body also having a locking tab, formed on the right end of said molded body and a receiver slot, formed on the left end of said molded body;

b) said molded body having a plurality of long slits formed therein at spaced apart intervals, wherein said long slits are formed within said molded body and do not extend to said top or bottom edges;

c) a plurality of proximate slits, formed in said bottom edge of said molded body, said plurality of proximate slits being positioned intermediate said long slits in an alternating pattern, said plurality of proximate slits extend from the bottom edge of said molded body to a point intermediate said top and bottom edges of said molded body, and further wherein said proximate slits separate said bottom edge of said molded body into a plurality of parted segments;

d) a plurality of distal slits, formed in said top edge of said molded body, said plurality of distal slits being positioned intermediate said long slits in an alternating pattern, said plurality of distal slits extend from the top edge of said molded body to a point intermediate said top and bottom edges of said molded body, and further wherein said distal slits separate said top edge of said molded body into a plurality of parted segments.

2. The combination flexible trivet and coaster of claim 1 further comprising a plurality of bridge segments, formed between the each of said distal slits each of said proximate slits and being positioned intermediate of a pair of said plurality of long slits.

3. The combination flexible trivet and coaster of claim 2 wherein the bridge segments are positioned at a point about ⅓ of the height of said molded body from the bottom edge.

4. The combination flexible trivet and coaster of claim 3 wherein the silicone is a high temperature silicone having a temperature resistant rating of at least 300° C.

5. The combination flexible trivet and coaster of claim 1, wherein each long slit has two ends and wherein said flexible trivet and coaster further comprises a circular opening, formed in each of said two ends of each of said long slits.

6. The combination flexible trivet and coaster of claim 1, wherein each proximate slit has an inside end and wherein said flexible trivet and coaster further comprises a circular opening, formed in each of said inside end of each of said proximate slits.

7. The combination flexible trivet and coaster of claim 1, wherein each distal slit has an inside end and wherein said flexible trivet and coaster further comprises a circular opening, formed in each of said inside end of each of said distal slits.

8. The combination flexible trivet and coaster of claim 1 wherein the molded body is made of silicone.

9. The combination flexible trivet and coaster of claim 1 wherein:

a) each long slit has two ends and wherein said flexible trivet and coaster further comprises a circular opening, formed in each of said two ends of each of said long slits;

b) wherein each proximate slit has an inside end and wherein said flexible trivet and coaster further comprises a circular opening, formed in each of said inside end of each of said proximate slits; and c) wherein each distal slit has an inside end and wherein said flexible trivet and coaster further comprises a circular opening, formed in each of said inside end of each of said distal slits.

10. The combination flexible trivet and coaster of claim 9 wherein the molded body is made of silicone.

11. The combination flexible trivet and coaster of claim 10 wherein the silicone is a high temperature silicone having a temperature resistant rating of at least 300° C.

12. A combination flexible trivet and coaster comprising:

a) a molded body having a generally rectangular shape having a left end, a right end, a top end, a bottom end and a height extending from the top end to the bottom end;

b) said molded body having a plurality of long slits, having curved ends, formed therein at spaced apart intervals, wherein said long slits are formed within said molded body and do not extend to said top or bottom edges;

c) a plurality of proximate slits, having a curved end, formed in said bottom edge of said molded body, said plurality of proximate slits, having a curved end, being positioned intermediate said long slits in an alternating pattern, said plurality of proximate slits extend from the bottom edge of said molded body to a point intermediate said top and bottom edges of said molded body, and further wherein said proximate slits separate said bottom edge of said molded body into a plurality of parted segments; and d) a plurality of distal slits, formed in said top edge of said molded body, said plurality of distal slits being positioned intermediate said long slits in an alternating pattern, said plurality of distal slits extend from the top edge of said molded body to a point intermediate said top and bottom edges of said molded body, and further wherein said distal slits separate said top edge of said molded body into a plurality of parted segments;

e) a plurality of bridge segments, formed between the each of said distal slits each of said proximate slits and being positioned intermediate of a pair of said plurality of long slits; and f) a locking tab, formed on the right end of said molded body and a receiver slot, formed on the left end of said molded body.

13. The combination flexible trivet and coaster of claim 12 wherein the bridge segments are positioned at a point about ⅓ of the height of said molded body from the bottom edge.

14. The combination flexible trivet and coaster of claim 12 wherein the molded body is made of silicone.

15. The combination flexible trivet and coaster of claim 14 wherein the silicone is a high temperature silicone having a temperature resistant rating of at least 300° C.

16. The combination flexible trivet and coaster of claim 12 wherein the silicone is colored.

* * * * *